US005707794A

United States Patent [19]

Fabricius

[11] Patent Number: 5,707,794

[45] Date of Patent: Jan. 13, 1998

[54] SPECTRAL SENSITIZATION OF SILVER HALIDE PHOTOGRAPHIC ELEMENTS

[75] Inventor: Dietrich Max Fabricius, Hendersonville, N.C.

[73] Assignee: Sterling Diagnostic Imaging, Inc., Brevard, N.C.

[21] Appl. No.: 755,437

[22] Filed: Nov. 22, 1996

[51] Int. Cl.[6] ..... G03C 1/29; G03C 1/24

[52] U.S. Cl. ..... 430/572; 430/580; 430/591; 430/594

[58] Field of Search ..... 430/572, 578, 430/591, 594, 580, 573

[56] References Cited

U.S. PATENT DOCUMENTS

| | | | |
|---|---|---|---|
| 2,493,748 | 1/1950 | Brooker et al. | 260/240 |
| 4,469,785 | 9/1984 | Tanaka et al. | 430/572 |
| 4,729,946 | 3/1988 | Kasama | 430/567 |
| 5,108,887 | 4/1992 | Fabricius et al. | 430/567 |
| 5,376,523 | 12/1994 | Henry et al. | 430/572 |
| 5,380,634 | 1/1995 | Kiekens et al. | 430/591 |
| 5,587,482 | 12/1996 | Fabricius et al. | 548/179 |

FOREIGN PATENT DOCUMENTS

| | | | |
|---|---|---|---|
| 0487010 | 3/1996 | European Pat. Off. | G03C 1/28 |
| 59-057232 | 9/1982 | Japan . | |
| 60-162247 | 2/1984 | Japan . | |
| 62-265656 | 5/1986 | Japan . | |
| 01029833 | 7/1987 | Japan . | |
| 3048840 | 7/1989 | Japan . | |
| 3168738 | 11/1989 | Japan . | |

*Primary Examiner*—Richard L. Schilling
*Attorney, Agent, or Firm*—Joseph T. Guy, Jr.

[57] ABSTRACT

Improved spectral sensitization with a synergistic combination of dyes is described. The two dyes include a first sensitizing dye is represented by Formula 1.

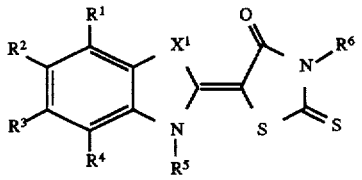

Formula 1 and a second dye represented by Formula 2.

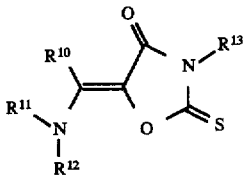

Formula 2

The substituents of are defined in the description.

18 Claims, No Drawings

SPECTRAL SENSITIZATION OF SILVER HALIDE PHOTOGRAPHIC ELEMENTS

FIELD OF INVENTION

The invention is related to improvements in spectral sensitization of silver halide photographic elements. More specifically, the present invention is related to specific dye combinations which provide unexpected synergism for superior spectral sensitization.

BACKGROUND OF THE INVENTION

Silver halide photographic emulsions are well known in the art. It is known in the art that silver halide emulsions can be spectrally sensitized to various regions of the electromagnetic spectrum to selectively increase the photographic response to specific wavelengths of actinic radiation.

Spectral sensitization of photographic emulsions to blue and ultra-violet radiation is a widely recognized desire in the art. Blue sensitization is desirable for a wide variety of applications. Color films which are sensitive to blue light and medical X-ray films which are exposed with a blue emitting phosphor are well characterized. Ultraviolet sensitization is predominantly utilized in medical x-ray films due, in part, to the superior resolution which can be obtained when ultraviolet sensitive medical X-ray films are used with ultraviolet emitting X-ray intensifying phosphors.

Zeromethine merocyanine dyes have been shown to be effective for spectral sensitization of tabular grains to blue light as detailed in U.S. Pat. No. 5,108,887 and U.S. patent application No. 08/612,354, filed Mar. 7, 1996 (DI-0035), now U.S. Pat. No. 5,587,482. The chemical composition of this class of compounds has been demonstrated to be critical to their ability to function as a spectral sensitizer.

A particular aspect of zeromethine merocyanine dyes, in particular, is their poor compatibility with other spectral sensitizing dyes. Prior to the present invention the commercial usefulness of the zeromethine dyes has been limited due to the lack of suitable cosensitizers which can be used in a synergistic fashion. In practice, addition of enough dye to achieve maximum sensitization was impractical since incomplete removal of the dye during processing frequently resulted in undesirable dye staining of the film. There has been a need in the art to achieve the sensitization levels available from zeromethine merocyanine dyes at lower total dye levels.

SUMMARY OF THE INVENTION

It is an object of the present invention to provide a silver halide photographic element with excellent sensitivity to specific wavelengths of light.

It is another object of the present invention to provide a silver halide photographic element which achieves excellent sensitivity to specific wavelengths of light with lower total dye in the photographic element.

A particular feature of the present invention is an increase in spectral response, measured as photographic speed, which can be achieved at lower total dye amounts.

These and other advantages, as will be apparent is provided in a photographic element comprising a support with at least one hydrophilic colloid layer coated thereon; said hydrophilic colloid layer comprises silver halide grains which are spectrally sensitized with at least one first dye represented by

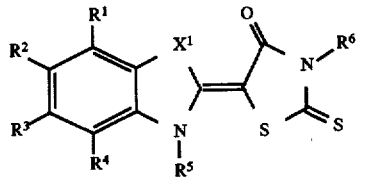

wherein: $R^1$, $R^2$, $R^3$, and $R^4$ independently represents H, halogen, alkyl, aryl, alkoxy, carbonyl or sulfonate, or $R^1$ and $R^2$ or $R^2$ and $R^3$ or $R^3$ and $R^4$ are taken together to represent the atoms necessary to complete a six-membered carbocylic ring; $X^1$ represents O, S, CH=CH, Se, Te, N—$R^7$, or C—$R^8R^9$; $R^5$ represents alkyl or aryl; $R^6$ represents H, alkyl or aryl; and $R^7$, $R^8$ and $R^9$ each independently represents alkyl; and at least one second dye represented by

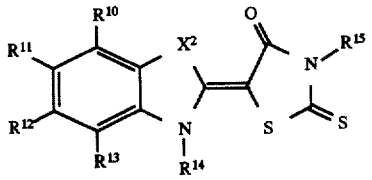

wherein: $R^{10}$, $R^{11}$, $R^{12}$, and $R^{13}$ each independently represents H, halogen, alkyl, aryl, alkoxy, carbonyl or sulfonate or $R^{10}$ and $R^{11}$ or $R^{11}$ and $R^{12}$ or $R^{12}$ and $R^{13}$ are taken together to represent the atoms necessary to complete a six-membered carbocylio ring; $X^2$ represents O, S, CH=CH, Se, Te, N—$R^{16}$, C—$R^{17}R^{18}$; $R^{14}$ represents alkyl or aryl; $R^{15}$ represents H, alkyl or aryl; $R^{16}$ represents alkyl; and $R^{17}$ and $R^{18}$ each independently represents alkyl.

An embodiment of the present invention is provided in a photographic element comprising a support with at least one hydrophilic colloid layer coated thereon; said hydrophilic colloid layer comprises silver halide grains which are spectrally sensitized with at least one first dye represented by:

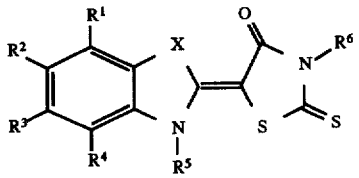

wherein $R^1$, $R^2$, $R^3$, and $R^4$ each independently represents H, halogen, alkyl, aryl, alkoxy, carbonyl, sulfonate, or trifluoroalkyl, or $R^1$ and $R^2$ or $R^2$ and $R^3$ or $R^3$ and $R^4$ are taken together to represent the atoms necessary to complete a six-membered carbocylic ring; X represents O, S, CH=CH, Se, Te, N—$R^7$, or C—$R^8R^9$; $R^5$ represents alkyl or aryl; $R^6$ represents M, alkyl or aryl; $R^7$ represents alkyl; and $R^8$ and $R^9$ each independently represents alkyl; and at least one second dye represented by

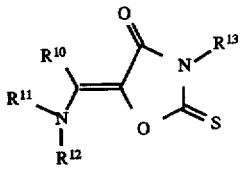

wherein $R^{10}$, $R^{11}$, and $R^{12}$ each independently represents H, alkyl, or aryl, or $R^{10}$ and $R^{11}$ are taken together to represent the atoms necessary to complete a five-membered heterocyclic ring or $R^{11}$ and $R^{12}$ are taken together to represent the atoms necessary to complete a five-membered or six-membered carbocylic ring; and $R^{13}$ represents H, alkyl or aryl.

Another embodiment of the present invention is provided in a photographic element comprising a support with at least one hydrophilic colloid layer coated thereon; said hydrophilic colloid layer comprises silver halide grains which are spectrally sensitized with at least one first dye represented by

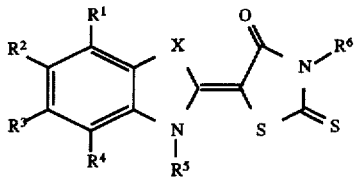

wherein $R^1$, $R^2$, $R^3$, and $R^4$ each independently represents H, halogen, alkyl, aryl, alkoxy, carbonyl, sulfonate, or trifluoroalkyl or $R^1$ and $R^2$ or $R^2$ and $R^3$ or $R^3$ and $R^4$ are taken together to represent the atoms necessary to complete a six-membered carbocylic ring; X represents O, S, CH=CH, Se, Te, N—$R^7$, C—$R^8R^9$; $R^5$ represents alkyl or aryl; $R^6$ represents H, alkyl or aryl; $R^7$ represents alkyl; and $R^8$ and $R^9$ each independently represents alkyl; and at least one second dye represented by

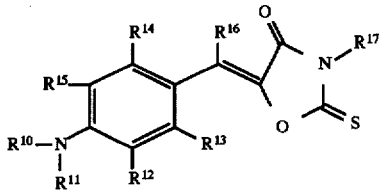

wherein $R^{10}$, $R^{11}$, $R^{12}$, $R^{13}$, $R^{14}$, and $R^{15}$ each independently represents H, alkyl, and aryl; or $R^{10}$ and $R^{11}$ or $R^{11}$ and $R^{12}$ or $R^{10}$ and $R^{15}$ or $R^{12}$ and $R^{13}$ or $R^{14}$ and $R^{15}$ are taken together to represent the atoms necessary to complete a five- or six-membered carbocylic ring; $R^{16}$ represents H, alkyl or aryl; and $R^{17}$ represents H, alkyl or aryl.

DETAILED DESCRIPTION OF THE INVENTION

The photographic element comprises a hydrophilic colloid layer with a silver halide grain dispersed therein. The silver halide grain is spectrally sensitized with at least one first sensitizing dye and at least one second sensitizing dye.

The first sensitizing dye is represented by Formula 1.

Formula 1

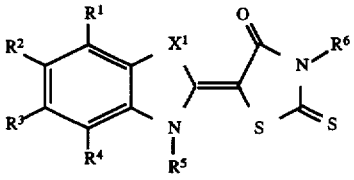

In Formula 1, $R^1$, $R^2$, $R^3$, and $R^4$ independently represent H, halogen, alkyi, aryl, alkoxy of 1–6 carbons, carbonyl, sulfonate, or trifluoroalkyl. Also the substituents $R^1$, $R^2$, $R^3$, and $R^4$ can represent carbocyliC ring structures. When $R^1$, $R^2$, $R^3$, and $R^4$ represent carbocylic ring structures $R^1$ and $R^2$ or $R^2$ and $R^3$ or $R^3$ and $R^4$ are taken together to represent the atoms necessary to complete a six-membered carbocylic ring. Preferably, $R^1$, $R^2$, $R^3$, and $R^4$ represent H, alkyl of 1–6 carbons, or one of the set chosen from $R^1$ and $R^2$ or $R^2$ and $R^3$ or $R^3$ and $R^4$ represents the carbon atoms necessary to form a naphthyl ring. $X^1$ represents O, S, CH=CH, Se, Te, N—$R^7$, or C—$R^8R^9$. Preferably $X^1$ represents O, S, Se, N—$R^7$. More preferably $X^1$ represents S or Se and most preferably $X^1$ represents S. $R^5$ represents hydrogen, alkyl or aryl. More preferably, $R^5$ represents alkyl of 1–6 carbons or aryl of 6 or 10 carbons. $R^6$ represents hydrogen, alkyl or aryl. More preferably, $R^6$ represents alkyl of 1–6 carbons or aryl of 6 or 10 carbons. Most preferably, $R^6$ represents an alkyl of 1–4 carbons substituted with a salt of carboxylic acid or sulfonate. $R^7$ represents H or alkyl. More preferably $R^7$ represent R or an alkyl of 1–6 carbons. $R^8$ and $R^9$ each independently represent H or alkyl. More preferably $R^8$ and $R^9$ each independently represent hydrogen or alkyl of 1–6 carbons.

The second dye is represented by Formula 2.

Formula 2

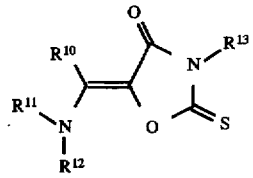

The substituents of Formula 2 are defined according to the following descriptions. $R^{10}$, $R^{11}$, and $R^{12}$ each independently represents H, alkyl, aryl or arylalkyl. $R^{10}$ and $R^{11}$ can be taken together to represent the atoms necessary to complete a five-membered heterocylic ring. $R^{11}$ and $R^{12}$ can be taken together to represent the atoms necessary to complete a five- or six-membered carbocylic ring chosen from quinoline, indole, benzothiazole, benzoselenazole, benzimidazole, benzoxazole, or benzotellurazole. Preferably $R^{10}$ is H, alkyl of 1–6 carbons or $R^{10}$ is taken with $R^{11}$ to represent the atoms necessary to form a five-membered heterocyclic ring. $R^{11}$ and $R^{12}$ preferably represent alkyl of 1–6 carbons, aryl of 6 or 10 carbons, or an arylalkyl of 7 or 11 carbons. $R^{13}$ represents alkyl or aryl. Preferably, $R^{13}$ represents an alkyl of 1–6 carbons. More preferably $R^{13}$ represents an alkyl of 1–6 carbons substituted a salt of carboxylic acid or sulfonate.

Most preferably the second dye is represented by Formula 3.

Formula 3

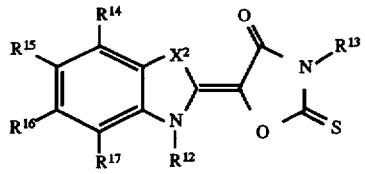

In Formula 3, $R^{12}$ and $R^{13}$ are as defined previously in reference to Formula 2. $R^{14}$, $R^{15}$, $R^{16}$, and $R^{17}$ each independently represent H, halogen, alkyl, aryl, alkoxy, carbonyl, sulfonate, or trifluoroalkyl. Taken together in adjacent pairs, $R^{14}$ and $R^{15}$ or $R^{15}$ and $R^{16}$ or $R^{16}$ and $R^{17}$ can represent the atoms necessary to complete a six-membered carbocylic ring. Preferably, $R^{14}$, $R^{15}$, $R^{16}$, and $R^{17}$ each independently represent H, halogen, alkyl of 1–6 carbons, aryl of 6 carbons, alkoxy of 1–3 carbons, carbonyl or sulfonate. $X^2$ represents O, S, CH=CH, Se, Te, N—$R^{18}$ or C—$R^{19}R^{20}$. Preferably, $X^2$ represents O, S, Se or N—$R^{18}$. More preferably, $X^2$ represents S or Se. Most preferably, $X^2$ represents S. $R^{18}$ represents H or alkyl. More preferably, $R^{18}$ represents H or alkyl of 1–6 carbons. $R^{19}$ and $R^{20}$ each independently represents H or alkyl. More preferably, $R^{19}$ and $R^{20}$ each independently represents H or alkyl of 1–6 carbons.

The terms "alkyl", "aryl", and "aralkyl" and other groups refer to both unsubstituted and substituted groups unless specified to the contrary. Alkyl can be saturated, unsaturated, straight chain or branched and unless otherwise specified refers to alkyls of 1 to 24 carbon atoms. More preferably, alkyl refers to alkyls of 1 to 6 carbons. Unless otherwise specified the term aryl refers to aryl of 6 to 24 carbons, more preferably 6 or 10 carbons. The term aralkyl refers to aralkyl of 7 to 25 carbons, more preferably 7 or 11 carbons. Preferred substituents include halogen; nitro; carboxyl in the form of a salt or carboxylic acid preferably sodium salt, potassium salt, ammonium salt or alkyl ammonium salt; hydroxyl; alkoxy; amine; thiol; amide; vinyl; sulfonate; cyano; alkylammonium, carbonyl and thioether.

The term "carbocyclic ring" refers specifically to unsubstituted and substituted aromatic carbon rings such as phenyl, napthyl, etc. wherein 5 or 6 membered carbon rings are either used alone or fused together. Carbocyclic ring substituents include halogen; nitro; Carboxyl in the form of a salt or carboxylic acid; hydroxyl; alkoxy; amine; thiol; amide; vinyl; sulfonate; cyano; alkylammonium, carbonyl and thioether. The term five- or six member heterocyclic ring refers to the atoms chosen from C, N, O, S, Se, and Te necessary to form a ring. Specifically preferred examples include phenyl, pyridine, pyrimidine, pyrazine, cyclopentane, cyclopentene, cyclohexane, cyclohexene, furan, pyran, pyrrole, pyrroline, pyrrolidine, piperidine, piperizine, pyridazine, quinoline, benzothiazole, benzoselenazole, benzoxazole, benzimidazole and benzotellurazole. The term aromatic 10-membered ring refers to the atoms chosen from C, N, O and S necessary to form an aromatic 10-membered ring. Specific examples include quinoline, naphthalene, phthalazine, naphthyridine, quinoxaline, quinazoline, cinnoline and pteridine.

The dyes of this invention may be dissolved in any of a host of suitable solvents including methanol, ethanol, water or dilute aqueous sodium hydroxide. The dyes of the present invention are useful for a myriad of applications known to the art. While not specifically limited thereto the preferred use is as a spectral sensitizer in photographic silver halide films elements.

When used as a sensitizing dye in a silver halide photographic element the dyes can be added as a concentrated slurry in the aforementioned solvents or more preferably as a solution. Time of addition is typically not critical. The dyes can be added at any time during the preparation of the silver halide grainst prior to or after the addition of gold and sulfur salts or after chemical sensitization is complete. Most preferable is addition during chemical sensitization. The amount of the first sensitizing dye added is preferably 10 to 5000 mg of dye per mole of silver and preferably from 20 to 2000 mg of dye per mole of silver. The amount of the second sensitizing dye added is preferably 0.5 to 2000 mg of dye per mole of silver and preferably from 1 to 200 mg of dye per mole of silver.

Any of the conventional halides may be used but preferred is pure silver bromide or silver bromide with up to 5% iodide, by weight, incorporated therein. A silver halide grain with 98% Br and 2% I, by weight, is suitable for demonstration of the utility of the inventive. Any grain morphology is suitable for demonstration of these teachings including, but not limited to, grains which are formed by splash techniques and those formed by spray techniques. Tabular grains with an aspect ratio of at least 2:1 are most preferred.

The grains are preferably dispersed in a binder (e.g. gelatin or other well-known binders such as polyvinyl alcohol, phthalated gelatins, etc.). In place of gelatin other natural or synthetic water-permeable organic colloid binding agents known in the art can be used as a total or partial replacement thereof. It is common to use binder adjuvants useful for increasing covering power such as dextran or the modified, hydrolysed gelatins of Rakoczy, U.S. Pat. No. 3,778,278.

It is most preferable to chemically sensitize the grain with salts that are well known in the art. The most common sensitizers are salts of gold or sulfur. Sulfur sensitizers include those which contain labile sulfur, e.g. allyl isothiocyanate, allyl diethyl thiourea, phenyl isothiocyanate and sodium thiosulfate for example. The polyoxyalkylene ethers in Blake et al., U.S. Pat. No. 2,400,532, and the polyglycols disclosed in Blake et al., U.S. Pat. No. 2,423,549. Other non-optical sensitizers such as amines as taught by Staud et al., U.S. Pat. No. 1,925,508 and Chambers et al., U.S. Pat. No. 3,026,203, and metal salts as taught by Baldsiefen, U.S. Pat. No. 2,540,086 may also be used.

The emulsions can contain known antifoggants, e.g. 6-nitrobenzimidazole, benzotriazole, tetraazaindenes, etc., as well as the usual hardeners, i.e., chrome alum, formaldehyde, dimethylol urea, mucochtoric acid, etc. Other emulsion adjuvants that maybe added comprise matting agents, plasticizers, toners, optical brightening agents, surfactants, image color modifiers, non-halation dyes, and covering power adjuvants among others.

The film support for the emulsion layers used in the novel process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. When polyethylene terephthalate is manufactured for use as a photographic support, it is preferable to use a mixed polymer subbing composition such as that taught by Rawlins, U.S. Pat. No. 3,567,452, Miller, U.S. Pat. Nos. 4,916,011 and 4,701,403, Cho, U.S. Pat. Nos. 4,891,308 and 4,585,730 and Schadt, U.S. Pat. No. 4,225,665. Upon completion of stretching and application of subbing composition, it is necessary to remove strain and tension in the base by a heat treatment comparable to the annealing of glass.

The emulsions may be coated on the supports mentioned above as a single layer or multi-layer element. For medical x-ray applications, for example, layers may be coated on both sides of the support which conventionally contains a dye to impart a blue tint thereto. Contiguous to the emulsion layers it is conventional, and preferable, to apply a thin stratum of hardened gelatin supra to said emulsion to provide protection thereto.

The emulsions of this invention can be used in any of the conventional photographic systems (e.g. negative or positive-working systems). Thus, they can contain any of the adjuvants related to the particular system employed. For example, the emulsions when employed as direct positive may be chemically fogged using metals such as rhodium or iridium and the like, or with other chemical fogging agents such as boranes, as well-known to those skilled in the art.

It is conventional to use the photographic emulsions of this invention with X-ray intensifying screens. These are usually used inpairs in cooperation with double-side coated medical X-ray silver halide photographic film elements, although it is sometimes common to use single-side coated silver halide photographic film elements for some applications. A pair of screens is conventionally used and the coating weights of each screen may be different, if required. Thus, an asymmetric pair of screens can be used to get the best results. Medical X-ray evaluations represent a commercial use for the photographic element comprising the inventive dye. The photographic element of the present invention is typically exposed by a phosphor cast into an X-ray intensifying screen.

Although any conventional silver halide photographic system can be employed to demonstrate the teachings of this invention a medical radiographic system will be used as an illustrative example.

Exemplary examples of the first sensitizing dye are provided in Tables 1 and 2.

TABLE 1

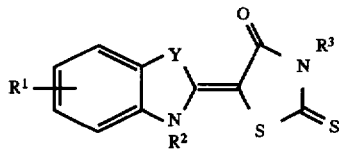

| Dye | X | $R^1$ | $R^2$ | $R^3$ |
|---|---|---|---|---|
| F1 | S | H | $CH_3$ | $CH_2CO_2H$ |
| F2 | S | H | $(CH_2)_3N(CH_3)_3Br$ | $CH_3$ |
| F3 | S | H | $(CH_2)_3N(CH_3)_3Br$ | $CH_2CH_3$ |
| F4 | S | H | $(CH_2)_3N(CH_3)_3Br$ | $CH_2CHCH_2$ |
| F5 | S | H | $(CH_2)_3N(CH_3)_3Br$ | $CH_2CO_2H$ |
| F6 | S | H | $(CH_2)_2N(CH_3)_3Br$ | $CH_2CO_2H$ |
| F7 | S | H | $(CH_2)_6N(CH_3)_3Br$ | $CH_2CO_2H$ |
| F8 | O | H | $(CH_2)_3N(CH_3)_3Br$ | $CH_2CO_2H$ |
| F9 | Se | H | $(CH_2)_3N(CH_3)_3Br$ | $CH_2CO_2H$ |
| F10 | Te | H | $(CH_2)_3N(CH_3)_3Br$ | $CH_2CO_2H$ |
| F11 | $NCH_3$ | H | $(CH_2)_3N(CH_3)_3Br$ | $CH_2CO_2H$ |
| F12 | CHCH | H | $(CH_2)_3N(CH_3)_3Br$ | $CH_2CO_2H$ |
| F13 | CHCH | H | $(CH_2)_3N(CH_3)_3Br$ | $CH_3$ |
| F14 | CHCH | H | $(CH_2)_3N(CH_3)_3Br$ | $CH_2CH_3$ |
| F15 | CHCH | H | $(CH_2)_3N(CH_3)_3Br$ | $CH_2CHCH_2$ |
| F16 | $NCH_3$ | H | $(CH_2)_3N(CH_3)_3Br$ | $CH_3$ |
| F17 | $NCH_3$ | H | $(CH_2)_3N(CH_3)_3Br$ | $CH_2CH_3$ |

TABLE 1-continued

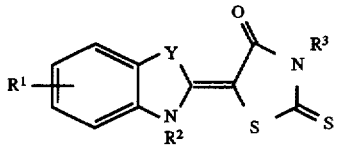

| Dye | X | $R^1$ | $R^2$ | $R^3$ |
|---|---|---|---|---|
| F18 | $NCH_3$ | H | $(CH_2)_3N(CH_3)_3Br$ | $CH_2CHCH_2$ |
| F19 | O | H | $(CH_2)_3N(CH_3)_3Br$ | $CH_2CH_3$ |
| F20 | Se | H | $(CH_2)_3N(CH_3)_3Br$ | $CH_2CH_3$ |
| F21 | Se | $CH_3$ | $CH_3$ | $CO_2H$ |
| F22 | S | Cl | $CH_3$ | $CH_2CO_2H$ |
| F23 | S | H | $(CH_2)_3SO_3HNEt_3$ | $CH_2CO_2H$ |
| F24 | S | H | $(CH_2)_4SO_3HNEt_3$ | $CH_2CO_2H$ |

TABLE 2

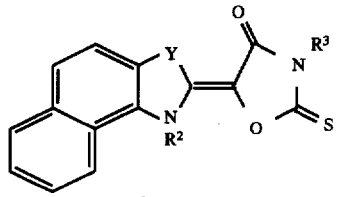

| Dye | Y | $R^2$ | $R^3$ |
|---|---|---|---|
| F25 | S | $(CH_2)_3N(CH_3)_3Br$ | $CH_3$ |
| F26 | S | $(CH_2)_3N(CH_3)_3Br$ | $CH_2CHCH_2$ |
| F27 | S | $(CH_2)_3N(CH_3)_3Br$ | $CH_2CO_2H$ |
| F28 | S | $(CH_2)_2N(CH_3)_3Br$ | $CH_2CO_2H$ |
| F29 | O | $(CH_2)_3N(CH_3)_3Br$ | $CH_2CO_2H$ |
| F30 | $NCH_3$ | $(CH_2)_3N(CH_3)_3Br$ | $CH_2CO_2H$ |
| F31 | $NCH_3$ | $(CH_2)_3SO_3HNEt_3$ | $CH_3$ |

Exemplary examples of the second sensitizing dye are provided in Tables 3–6.

TABLE 3

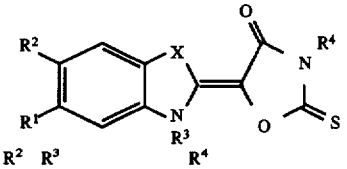

| Dye | X | $R^1$ | $R^2$ | $R^3$ | $R^4$ | $\lambda_{MAX}(\epsilon\ 10^{-4})$ | mp(°C.) |
|---|---|---|---|---|---|---|---|
| S1 | S | $OCH_3$ | H | $(CH_2)_3SO_3HNEt_3$ | $CH_2CH_3$ | 413(6.0) | 181–183 |
| S2 | Se | $CH_3$ | H | $(CH_2)_3SO_3K$ | $CH_2CH_3$ | 409(6.0) | 351 |
| S3 | Se | $CH_3$ | H | $CH_3$ | $CH_2CH_3$ | 408(7.3)<br>372(5.8) | 290–292 |
| S4 | Se | $CH_3$ | H | $CH_3$ | $CH_2CH_2SO_3K$ | 407(5.3) | >350 |
| S5 | S | H | H | $(CH_2)_3SO_3K$ | $CH_2CH_3$ | 405(5.5) | >350 |
| S6 | S | H | H | $(CH_2)_4SO_3HNEt_3$ | $CH_2CH_3$ | 405(6.8) | 187 |
| S7 | S | H | H | $(CH_2)_2SO_3K$ | $CH_2CH_3$ | 404(5.5) | >350 |
| S8 | S | H | H | $CH_3$ | $CH_2CH_3$ | 404(6.0) | 240–242 |
| S9 | S | Cl | H | $CH_3$ | $CH_2CH_3$ | 404(6.7) | 291 |
| S10 | S | Cl | Cl | $CH_3$ | $CH_2CH_2SO_3K$ | 404(7.5) | >350 |
| S11 | S | Cl | H | $CH_3$ | $CH_2CH_2SO_3K$ | 403(5.5) | >350 |
| S12 | S | H | H | $CH_3$ | $CH_2CH_2SO_3K$ | 403(4.9)<br>384(sh) | >350 |
| S13 | S | H | H | $(CH_2)_3SO_3^-K^+$ | $CH_2CH_2SO_3^-$ | 403(2.6)<br>383(3.3) | 295–308 |
| S14 | NEt | Cl | Cl | $(CH_2)_3SO_3^-K^+$ | $CH_2CH_3$ | 403(2.0) | d.230 |
| S15 | S | H | H | $CH_3$ | $CH_2CO_2H$ | 402(5.5) | 296 |
| S16 | S | Cl | H | $CH_3$ | $CH_2CO_2H$ | 402(6.6) | 324 |
| S17 | NMe | Cl | Cl | $CH_3$ | $CH_2CH_3$ | 400(6.3) | 274–276 |

TABLE 3-continued

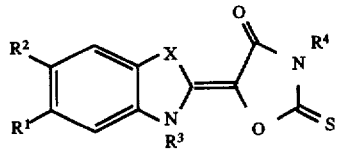

| Dye | X | $R^1$ | $R^2$ | $R^3$ | $R^4$ | $\lambda_{MAX}(\epsilon\ 10^{-4})$ | mp(°C.) |
|---|---|---|---|---|---|---|---|
| S18 | NMe | Cl | Cl | $(CH_2)_3SO_3HNEt_3$ | $CH_2CH_3$ | 400(8.0) | 268–270 |
| S19 | S | $CF_3$ | H | $CH_3$ | $CH_2CH_2SO_3HNEt_3$ | 398(6.0) | >350 |
| S20 | S | $CF_3$ | H | $CH_3$ | $CH_2CH_3$ | 397(6.7) | 278 |
| S21 | N-iP | Cl | H | $CH_3$ | $CH_2CH_3$ | 395(4.7)<br>385(4.3) | 182–185 |
| S22 | NMe | $SO_3^+Na^+$ | H | $CH_3$ | $CH_2CH_3$ | 394(3.3) | d. 310 |
| S23 | NMe | $CH_3$ | H | $CH_3$ | $CH_2CH_3$ | 392(4.9)<br>379(5.0) | 178–180 |
| S24 | NMe | H | H | $CH_3$ | $CH_2CH_3$ | 390(4.9) | 191–193 |
| S25 | O | Cl | H | $CH_3$ | $CH_2CH_2SO_3K$ | 382(5.4) | >350 |
| S26 | O | Cl | H | $CH_3$ | $CH_2CH_3$ | 379(5.4)<br>372(5.8) | |

Me is methyl, Et is ethyl and iP is isopropyl.

TABLE 4

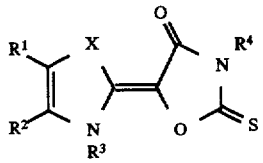

| Dye | X | $R^1$ | $R^2$ | $R^3$ | $R^4$ | $\lambda_{MAX}$ ($\epsilon \times 10^{-4}$) | mp(°C.) |
|---|---|---|---|---|---|---|---|
| S27 | N−Me | Ph | Ph | $CH_3$ | $CH_2CH_3$ | 362(4.0) | 205–216 |
| S28 | O | Ph | Ph | $CH_3$ | $CH_2CH_3$ | 380(4.2)<br>397(sh) | 207–210 |

Me is methyl.

TABLE 5

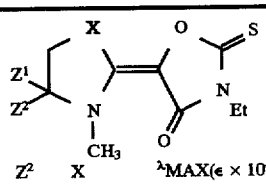

| Dye | $Z^1$ | $Z^2$ | X | $\lambda MAX(\epsilon \times 10^{-4})$ | mp(°C.) |
|---|---|---|---|---|---|
| S29 | H | H | S | 353(4.7) | 118 |
| S30 | H | H | $CH_2$ | 344(3.1) | 106 |
| S31 | Me | Me | O | 334(1.4) | oil |

Me is methyl.

TABLE 6

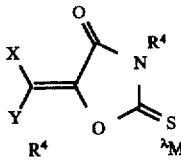

| Dye | X | Y | $R^4$ | $\lambda MAX(\epsilon \times 10^{-4})$ | mp(°C.) |
|---|---|---|---|---|---|
| S32 | $Me_2N$ | H | $CH_2CH_3$ | 348(3.2) | 125–127 |
| S33 | $Me_2N$ | $CH_3$ | $CH_2CH_2SO_3K$ | 351(2.5) | d. 283 |

TABLE 6-continued

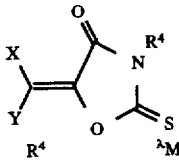

| Dye | X | Y | $R^4$ | $\lambda MAX(\epsilon \times 10^{-4})$ | mp(°C.) |
|---|---|---|---|---|---|
| S34 | $Me_2N$ | $CH_3$ | $CH_2CH_3$ | 352(3.4) | 130, 134 |
| S35 | 4−$Me_2N$−Ph− | H | $CH_2CH_3$ | 439(3.1) | 138–145 |

Me is methyl and Ph is phenyl.

DYE SYNTHESES

Other inventive dyes can be prepared in a manner analogous to the exemplary procedures detailed below. The substituted rhodanine can be substituted with oxazolidinone or thiohydantoin to form the dye derivatives with Y being O or $NR^{10}$. Substituting a thioxo-4-oxazolidinone for rhodanine can be used to synthesize the dye derivatives with Z being oxygen. Inventive dyes with Z being Se can be prepared in a manner analogous to that taught in u.S. Pat. No. 2,332,433. The substituted benzothiazole of the exemplary preparation examples can be replaced by appropriately substituted benzoxazole, benzselenazole, benztellurazole, quinoline or benzimidazole as necessary to form the dyes not specifically taught in the exemplary procedure. All of the preparation procedures use standard organic preparative techniques which are well known to the skilled artisan.

Preparation Of Dye Intermediates 3-(Bromopropyl)trimethylammonium bromide (Int-A). Trimethylamine (21.1 ml) was condensed at −78° C. (dry ice/isopropanol) and added to stirred and ice-cooled 1,3-dibromopropane (56.65 gm, 0.266 mol) in 135 ml toluene. The solution hazed immediately, but was allowed to stir 2.5 days. The white precipitate was collected by filtration to yield 63.34 gm, which was dried by vacuumto give 51.36 gm (87%), mp. 203°–207° C. (dec.)

2-(3-Trimethlammoniumpropylthio)benzothiazole bromide (Int-B).

Potassium hydroxide (56 gm, 1 mol) was added to a slurry of 2-mercaptobenzothiazole (167 gm, 1 mol) in 600 ml 95% ethanol to give a dark solution. 3-(Bromopropyl)

trimethylammonium bromide (Int-A) (261 gm, 1 mol) was added and the mixture heated to reflux for 55 min. Upon cooling, potassium bromide precipitated and was removed by filtration. The filtrate was evaporated and the residue recrystallized from isopropanol to obtain 182.52 gm, mp 167°–170° C. An additional 97.86 gm was obtained from concentration of the filtrate.

2-(3-Trimethylammoniumpropylthio)-3-(3 trimethyl ammoniumpropyl)-benzothiazole dibromide (Int-C).

2-(3-Trimethyl ammoniumpropylthio)-benzothiazole bromide (Int-B) (86.30 gm, 0.248 mol) and 68.53 gm (0.26 mol) 3-(Bromopropyl)trimethyl ammonium bromide were heated together with mechanical stirring at 133°–147° C. in an 156° C. oil bath for 5 hours. The product was cooled to 89° C. before adding 200 ml methanol to give a black solution. The solution was filtered prior to use in subsequent dye condensations.

2-Methylthio-1-(3-Trimethylammoniumnpropylthio) benzimidazolium bromide (Ink-D).

2-Methylthiobenzimidazole (8.2 gm, 0.05 mol., from Aldrich Chemical Co.) was slurried in 50 ml dry THF. 60% NaH (2.0 g) was washed with o-xylene and added as a slurry to previous mixture. After considerable gas evolution, the mixture nearly cleared to a brown solution. Trimethylammoniumpropyl bromide (13.05 gm, 0.05 mol) was added and resulting mixture stirred at room temperature overnight. The mixture was filtered and the recovered hygroscopic white solid was washed several times with acetone and then vacuum-dried to yield 9.84 gm (57% yield), mp 175° C. (dec). $C^{13}$ NMR was satisfactory.

1-Methyl-2-Methylthio-3-(3 Trimethylammoniumpropylthio) benzimidazolium bromotosylate (Int-E).

Int-D (3.44 gm, 0.01 mol), methyl tosylate (2.0 gm, 0.01 mol) and 20 ml o-xylene were mixed together and heated to reflux. After five hours, the mixture was cooled, mixed with acetone, and filtered to collect 4.50 gm, mp 250° C. (dec). NMR analysis revealed a purity of ~62% with 38% residual starting material. The entire product was refluxed with 6.0 gmmethyl tosylate in 25 ml o-xylene for an additional 5 hours. Cooling and treatment with acetone yielded 2.96 gm product, mp >350° C.

3-Methyl-2-(methylthio)benzothiazolium p-toluenesulfonate (Int-F) (disclosed in U.S. Pat. No. 5,102,781) 2-(Methylthio) benzothiazole (543.1 g, 3.0 mol) was melted, placed in an 5000 ml 3-neck flask with mechanical stirrer, and mixed with 558.0 g (3.0 mol) melted methyl p-toluenesulfonate and 1800 ml o-xylene. The mixture was heated to reflux for seven hours after the reflux temperature had dropped from 151° C. to 144° C. Product formation first occurs at 115° C. where product precipitation begins. The reaction is allowed to cool to room temperature before filtering the mixture. The filter cake is washed with acetone until the washings are colorless. The product is removed from the filter, stirred with 2000 ml acetone for at least one hour, filtered, washed with acetone, and vacuum- or air-dried to give 909.6 g (83%), mp 173°–174° C.

5-Chloro-2-(methylthio)benzothiazole (Int-G) (disclosed in U.S. Pat. No. 5,102,781) 5-Chloro-2-mercaptobenzothiazole (40.34 g 0.2 mol) in 100 ml 95% ethanol was treated with 20.2 g (0.2 mol) triethylamine. The resulting slurry was heat to reflux to dissolve and filtered warm to remove insolubles. After cooling to <40° C., iodomethane (12.5 ml, 0.2 mol) was added. causing the mixture to exotherm to 44° C. The reaction mixture Was refluxed for 2.5 hours. Cooling yielded copious crystals, which were filtered and alcohol washed to yield 24.63 g, mp 68°–71° C.

5-chloro-2-methylthio-3-methylbenzothiazolium tosylate (Int-H) (disclosed in U.S. Pat. No. 5,102,781) 5-Chloro-2-(Methylthio)benzothiazole (Int-G) (5.0 g, 0.023 mol) and 4.40 g methyl p-toluenesulfonate were heated to 152° C. for 7 minutes. Upon cooling, the mixture solidified and then was triturated with acetone to give 7.82 g (84%), mp 170°–185° C.

5-Chloro-2-(methylthio)-benzoxazole (Int-I).

5-chloro-2-hydroxyaniline (143.57 g, 1 mol) and potassium ethylxanthate (160.3 g, 1 mol) were mixed with 2000 ml 95% ethanol in a 3-neck 5000 ml flask connected to aqueous KOH and Clorox™ scrubbing trains. The mixture was carefully heated to reflux for 5.5 hrs when $H_2S$ bubbling ceased. The mixture was cooled to <40° C. Iodomethane (63 ml) was added. Considerable precipitation occurred, but all redissolved as the mixture was reheated to reflux for 30 min. After cooling overnight, the resulting crystals were collected by filtration and then washed with distilled water. After filtering and drying, the yield was 103 g, mp 89° C. Additional 51 g of product was obtained by treating the alcohol filtrate with an equal volume of water, collecting the product and washing it with water. If necessary, the second crop can be recrystallized from 95% ethanol.

5-Chloro-3-methyl-2-(methylthio)benzoxazolium p-toluenesulfonate (Int-J)

5-Chloro-2-(methylthio)-benzoxazole (Int-I) (19.9 g, 01 mol) and 18.7 g methyl p-toluenesulfonate were heated to 140°–150° C. for 2.5 hrs. Upon cooling to 60° C., acetone was added to cover and slurry. The product was collected by filtration, crushed, and slurried overnight in acetone. Filtration and drying yielded 21.37 g (56%), mp 145°–164° C.

5,6-Dichloro-3-methyl-2-(methylthio)benzimidazole (Int-K)

5,6-dichloro-2-mercaptobenzimidazole (8.76 g, 0.04 mol) in 50 ml 95% ethanol was treated with 10 ml of 45% aqueous potassium hydroxide to give a solution. Iodomethane (7 ml, 0.096 mol) was added. The reaction mixture was refluxed for two hours. Cooling overnight yielded precipitant, which was filtered, water-washed, and dried to yield 5.61 g, mp 115° C. The reaction filtrate was rotary evaporated and the residue reslurried in water. After filtration and drying, an additional 3.52 g was obtained, mp 110° C. NMR analysis indicated the presence of some 5,6-DiChloro-2-(methylthio) benzimidazole as an impurity.

5,6-Dichloro-1,3-dimethyl-2-(methylthio)benzimidazolium p-toluenesulfonate (Int-L)

5,6-Dichloro-3-methyl-2-(methylthio)benzimidazole (Int-k) (5.58 g, 0.022 mol) and 4.22 g methyl p-toluenesulfonate were mixed with 10 ml xylenes and heated to 124°–136° C. for 5 hrs. Upon cooling to 60° C., acetone was added to cover and slurry. The product was collected by filtration and reslurried in acetone. Filtration and drying yielded 3.14 g, mp 152°–156° C. The product was again slurried with acetone overnight to give 2.38 g, mp 152°–155° C., which NMR indicated was contaminated with some unreacted starting material.

Acetamidocarbothiolonglycolic acid (Int-M)

Acetamidocarbothiolonglycolic acid was obtained from Aldrich Chemical Co. and was prepared by the method of Ahlqvist, J Prakt. Chem., 99 (2), 48 (1919).

3-(2-Sulfoethyl)-2-thioxo-4-oxazolidinone (Int-N)

Acetamidocarbothiolonglycolic acid (Int-M) (8.20 g, 0.04 mol) and taurine (5.00 g, 0.04 mol) were mixed together in 40 ml water. Potassium carbonate (7.41 g) was added portion wise to give a green slurry at pH near 10. After 3.5 hrs, the pH was adjusted to 8 with an additional 1.34 g potassium carbonate. The mixture was stirred for 24 hrs, filtered to remove greenish byproduct, and then acidified with hydrochloric acid. The solution was rotary evaporated at 80° C. to a residue, which was taken up in hot water, and then chilled. The unreacted taurine crystals were removed and filtrate poured into 200 ml stirred acetone to precipitate potassium chloride. The acetone-water filtrate was poured into an additional 200 ml acetone to precipitate product, which after filtering and drying, yielded 2.43 g, mp 273° C. The acetone-water filtrate was concentrated to a yellow oil, treated with 150 ml acetone and some methanol to give 1.63 g additional product, mp 268° C. Repeat of this process yielded another 1.08 g product, mp 276° C.

3-(2-Carboxymethyl)-2-thioxo-4-oxazolidinone (Int-O)

Acetamidocarbothiolonglycolic acid (Int-M) (8.20 g, 0.04 mol) and glycine (3.00 g, 0.04 mol) were mixed together in 40 ml water. Potassium carbonate (9.37 g) was added portion wise to give a green slurry at pH near 10. The mixture was stirred for 24 hrs, filtered to remove greenish byproduct, and then acidified with hydrochloric acid. The solution was rotary evaporated at 80° C. to a residue, which was taken up in water. The undissolved material was removed and filtrate poured into 400 ml stirred acetone to precipitate potassium chloride. The acetone-water filtrate was concentrated to a oil, treated with additional acetone, filtered to remove insolubles, and then reconcentrated. The concentrate was dissolved in water, treated with 2 ml concentrated hydrochloric acid, and heated at 70°–80° C. for 2 hrs. The mixture was concentrated, dissolved in isopropanol, treated with 50% KOH, and filtered to remove insolubles. The solution chilled, diluted with additional isopropanol, and the phases separated. The isopropanol phase was diluted with acetone, then with water, and acidified with concentrated hydrochloric acid to pH 4. Pouring into 450 ml acetone precipitated potassium salts, which were removed before concentrating the acetone filtrate to 6.33 g of oil.

Exemplary Dye Preparation Techniques

Dye-F1

Prepared by the method described in U.S. Pat. No. 5,102,781.

Dye-F2

In a manner similar to the preparation of Dye-1, Int-C was reacted with 6.27 gm (0.043 mol) 3-methylrhodanine and 4.58 gm (0.045 mol) triethylamine. After six hours, the dye was collected by filtration and washed twice with 50 ml methanol to yield 5.81 gm (10.3%), mp 278°–279° C. $\lambda_{max}$=424 ($\epsilon$=61,000).

Dye-F3

In a manner similar to the preparation of Dye-1, Int-C was reacted with 6.60 gm (0.041 mol) 3-ethylrhodanine and 4.14 gm (0.041 mol) triethylamine. After 24 hours, a small amount of dye was collected by filtration. The filtrate was evaporated and the residue treated with 20 ml conc. HCl and 1000 ml water. The aqueous phase was decanted away from the resulting oil, further diluted with 2000 ml water and treated with aq. KOH to precipitate the dye. After filtering and washing with methanol, the yield was 1.14 g, mp 245°–248° C. $\lambda_{max}$=425 ($\epsilon$=75,000).

Dye-F4

In a manner similar to the preparation of Dye-1, Int-C was reacted with 4.69 gm (0.027 mol) 3-allylrhodanine and 2.73 gm (0.027 mol) triethylamine. After five hours, the dye was collected by filtration and washed twice with 50 ml methanol to yield 5.17 gm (8.7%), mp 255°–257° C. $\lambda_{max}$=425 ($\epsilon$=84,000).

Dye-F5

An equimolar amount of Int-C was mixed with 18.36 gm (0.096 mol) 3-carboxymethylrhodanine and 9.25 gm (0.092 mol) triethylamine. After stirring 24 hrs. at room temperature, the reaction mixture was filtered and washed with methanol to yield 2.92 gm green-yellow powder, mp 285°–286° C. $\lambda_{max}$=424 nm ($\epsilon$=61,000). An additional 5.19 gm dye was obtained by allowing the filtrate to react longer.

Dye-F11

Int-E (2.96 gm, 0.0048 mol), 3-carboxymethylrhodanine (0.91 gm, 0.0048 mol), 10 ml dimethylformamide, and triethylamine (0.96 gm 0.0096 mol) were stirred together at room temperature for five hours. The mixture was filtered, the filtrate acidified with conc. HCl, and diluted with isopropanol to precipitate tosylate salts. The precipitant was removed by filtration and filtrate rotary evaporated to remove all solvent. The residue was treated with acetone and the precipitated triethylammonium salts removed by filtration. The acetone solution was concentrated by rotary evaporation and then poured into ethyl acetate to precipitate a yellow oil. The solvent was decanted away, the oil dissolved in isopropanol, and then poured into ethyl acetate to precipitate a gum. The solvent was decanted away, the oil dissolved in methanol/isopropanol, and then poured into ethyl acetate to precipitate a yellow solid, 0.06 gm, $\lambda_{max}$= 412 nm.

Dye-S6 was obtained from Riedel de Haen AG.

Dye-S8.

3-Ethyl-2-thioxo-4-oxazolidinone (4.35 g, 0.03 mol) in 60 ml dimethylformamide were treated with triethylamine (3.03 g, 0.03 mol), followed by 3-methyl-2-(methylthio) benzothiazolium p-toluenesulfonate (Int-F) (11.07 g, 0.03 mol). The resulting slurry was stirred 1.25 hrs, filtered, and the product reslurried in methanol. Filtering and drying yielded 4.13 g, mp 240° C., $\lambda_{max}$=404 nm ($\epsilon$=60,000). An additional 2–5 g product was obtained by allowing the reaction filtrate to continue stirring overnight with an additional 0.3 g triethylamine.

Dye S9

3-Ethyl-2-thioxo-4-oxazolidinone (0.72 g, 0.005 mol) in 15 ml dimethylformamide were treated with triethylamine (0.51 g, 0.005 mol), followedby 5-chloro-2-methylthio-3-methylbenzothiazolium tosylate (Int-H) (2.01 g, 0.005 mol). The resulting slurry was stirred 1.5 hrs, filtered, and the product reslurried in isopropanol. Filtering and drying yielded 0.70 g, mp 291° C., $\lambda_{max}$=404 nm (e=67,000).

Dye S12

3-(2-Sulfoethyl)-2-thioxo-4-oxazolidinone (Int-N) (2.63 g, 0.01 mol), 3-Methyl-2-(methylthio)-benzothiazolium p-toluenesulfonate (Int-F) (3.67 g, 0.01 mol), triethylamine (2.2 g, 0.022 mol), and 50 ml dimethylformamide were mixed together. Within 10 minutes, dye began to precipitate. After 4 hrs., the mixture was filtered and the collected dye was reslurried in methanol. Filtration and drying yielded 1.39 g, mp >350° C., $\lambda_{max}$=403 nm (e=42,000), 384 nm (38,000). Continuation of the reaction an additional two days yielded, after the same work-up, an additional 0.48 g of dye, mp 346° C., $\lambda_{max}$=403 nm ($\epsilon$=56,000), 384 nm (54,000).

Dye S15

3-(2-Carboxymethyl)-2-thioxo-4-oxazolidi-none (Int-N) (4.51 g as 38.8% solution in dimethylformamide), 3-Methyl-2-(methylthio)-benzothiazolium p-toluenesulfonate (Int-F) (3.67 g, 0.01 mol), triethylamine (2.2 g, 0.022 mol), and 30 ml dimethylformamidewere mixed together. Dye precipitation began immediately and stirring was continued with difficulty for 25.5 hrs. The mixture was filtered and the collected dye was reslurried twice in methanol. After filtration, the dye was slurried in methanol and acidified with 1.5 ml concentrated hydrochloric acid. After stirring 1 hr, the dye slurry was filtered and then reslurried in methanol. Filtration and drying yielded 0.95 g, mp 297° C., $\lambda_{max}$=402 nm ($\epsilon$=55,000).

Dye-S17

3-Ethyl-2-thioxo-4-oxazolidinone (0.725 g, 0.005 mol) and 5,6-Dichloro-1,3-dimethyl-2-(methylthio)benzimidazolium p-toluenesulfonate (Int-L) (2.16 g, 0.005 mol) in 10 ml dimethylformamide were treated with triethylamine (1.1 g, 0.01 mol). Dye precipitation occurred within five minutes. The mixture continued stirring for 5.3 hrs. The product was collected by filtration and washed with water. After drying, the yield was 0.68 g, mp 274°–276° C., $\lambda_{max}$=400 nm ($\epsilon$=63,000).

Dye S26

3-Ethyl-2-thioxo-4-oxazolidinone (1.45 g, 0.01 mol) and 5-chloro-3-methyl-2-(methylthio)benzoxazolium p-toluenesulfonate (Int-J) (3.85 g, 0.01 mol) in 13 ml dimethylformamide were treated with triethylamine (1.1 g, 0.01 mol). Dye precipitation occurred within five minutes. The mixture continued stirring for 1.5 hrs. The white product was collected by filtration and washed with acetone. After drying, the yield was 0.46 g, mp 287° C., $\lambda_{max}$=379 nm ($\epsilon$=58,000), 372 nm (sh).

Dye S34

3-Ethyl-2-thioxo-4-oxazolidinone (4.40 g, 0.0303 mol) and N,N-dimethylacetamide dimethyl acetal (4.03 g, 0.0303 mol) in 15 ml dimethylformamide were stirred together at room temperature for 34 minutes. The mixture was filtered and washed with dimethylformamide to yield ~2.2 g yellow solid. This was slurried in isopropanol, filtered, and dried to yield 1.32 g product, mp 130° C., $\lambda_{max}$=352 nm ($\epsilon$=32,000). Additional dye was obtain by treating the dimethylformamide filtrate with water to precipitate copious white solid. The solid was collected by filtration, reslurried in isopropanol, filtered, and dried to yield an additional 1.25 g, mp 134° C., $\lambda_{max}$=352 nm ($\epsilon$=34,000).

Dye S35

3-Ethyl-2-thioxo-4-oxazolidinone (3.12 g, 0.025 mol) and 4-dimethylaminobenzaldehyde (3.72 g, 0.025 mol) in 25 ml denatured ethanol were treated with triethylamine (2.5 g, 0.025 mol). The mixture was heated at reflux for 6 hrs. and allowed to stir at room temperature overnight. The precipitated dye was collected by filtration and washed with 95% ethanol. After drying, the yield was 4.03 g, mp 138°–145° C., $\nu_{max}$=439 nm ($\epsilon$=31,000).

EMULSION PREPARATION

EXAMPLE 1

A silver bromide tabular grain emulsion was prepared according to the teachings of Ellis, U.S. Pat. No. 4,801,522. After precipitation of the grains, the average aspect ratio was determined to be 5:1 and thickness of about 0.2 μm. These grains were dispersed in photographic gelatin (about 188 grams gelatin/mole of silver bromide). The emulsion was brought to its optimum sensitivity with gold and sulfur salts as is well-known to those skilled in the art. A solution of the first dye F1 with tri-n-butylamine in methanol was added at the appropriate level as indicated in the table. The emulsion was stabilized by the addition of 4-hydroxy-6-methyl-1,3, 3a, 7-tetraazaindene and potassium bromide. Dye II was added as a suspension in methanol. The usual wetting agents, antifoggants, coating aids, and hardeners were added and this emulsion was then coated on a dimensionally stable, 7 mil polyethylene terephalate film support which had first been coated with a conventional resin sub followed by a thin substratum of hardened gelatin applied supra thereto. These subbing layers were present on both sides of the support. The emulsion was. coated on one side at about 2 g silver per square meter. A thin abrasion layer of hardened gelatin was applied over the emulsion layer. Samples of each of these coatings were given an exposure through a test target and a conventional step wedge to X-rays interacting with a Ultravision™ U-V Rapid ultraviolet-emitting X-ray intensifying screen available from Sterling Diagnostic Imaging, Inc., Glasgow, Del. After exposure the film was developed in a conventional X-ray film processor. Evaluation of the samples is summarized in Table 7. In the following examples, Rel. Speed is relative speed; Amt is amount of dye in mg/mole of silver; B+F is the optical density of the base plus photographic fog; Me is methyl; Et is ethyl; and SLF is safe light fog.

TABLE 7

| Dye I | Amt | Dye II | Amt | B + F | Rel. Speed |
|---|---|---|---|---|---|
| F1 | 260 | — | 0 | .22 | 100 |
| F1 | 219 | S34 | 35 | .20 | 114 |
| F1 | 219 | S9 | 35 | .21 | 118 |
| F1 | 219 | S26 | 35 | .21 | 115 |
| F1 | 219 | S6 | 35 | .20 | 118 |

The results of Example 1 illustrate that an increase in spectral sensitivity can be achieved as indicated by the increased relative speed. Furthermore, this increase in speed is achieved with lower total dye added. A beneficial reduction is B+F is also illustrated for the inventive samples.

EXAMPLE 2

An emulsion was prepared as in Example 1. The dyes evaluated and the results are in Table 8.

TABLE 8

| Dye I | Amt | Dye II | Amt | B + F | Rel. Speed |
|---|---|---|---|---|---|
| F1 | 167 | — | 0 | .20 | 100 |
| F1 | 167 | S17 | 6.7 | .18 | 107 |
| F1 | 259 | — | 0 | .19 | 100 |
| F1 | 197 | S12 | 16.7 | .19 | 108 |

The synergistic activity of the dyes is illustrated in Example 2. An increase in either dye alone is inferior to the results of the combination of dyes.

EXAMPLE 3

An emulsion was prepared as in Example 1. The dyes evaluated and results are in Table 9.

TABLE 9

| Dye I | Amt | Dye | Amt | B + F | Rel. Speed | SLF |
|---|---|---|---|---|---|---|
| F1 | 260 | — | — | .18 | 100 | .12 |
| F1 | 197 | S12 | 31.5 | .17 | 114 | .22 |
| — | — | S12 | 31.5 | .19 | 110 | .50 |
| F1 | 197 | S6 | 39.3 | .19 | 112 | .28 |
| — | 0 | S6 | 395 | .17 | 65 | .09 |

EXAMPLE 4

An emulsion was prepared as in Example 1. The dyes evaluated and results are in Table 10.

TABLE 10

| Dye I | Amt | Dye II | Amt | B + F | Rel. Speed |
|---|---|---|---|---|---|
| F1 | 259 | — | — | .19 | 100 |
| F1 | 197 | — | — | .19 | 100 |
| F1 | 197 | S15 | 32.7 | .18 | 107 |
| — | — | S15 | 32.7 | .18 | 61 |
| — | — | S15 | 132 | .20 | 81 |

EXAMPLE 5

An emulsion was prepared as in Example 1. The dyes evaluated and results are in Table 11.

TABLE 11

| Dye I | Amt | Dye II | Amt | B + F | Rel. Speed |
|---|---|---|---|---|---|
| F1 | 259 | — | — | .19 | 100 |
| F1 | 197 | S15 | 33.3 | .21 | 117 |
| F1 | 197 | S15 | 66.7 | .21 | 116 |
| — | — | S15 | 100.7 | .19 | 95 |
| — | — | S15 | 166 | .19 | 89 |

EXAMPLE 6

An emulsion was prepared as in Example 1. The dyes evaluated and results are in Table 12.

TABLE 12

| Dye I | Amt | Dye II | Amt | B + F | Rel. Speed |
|---|---|---|---|---|---|
| F1 | 167 | — | — | .21 | 100 |
| F1 | 167 | S35 | 0.7 | .20 | 109 |
| F1 | 167 | S35 | 1.3 | .20 | 107 |

EXAMPLE 7

An emulsion was prepared as in Example 1. The dyes evaluated and results are in Table 13.

TABLE 13

| Dye I | Amt | Dye II | Amt | B + F | Rel. Speed |
|---|---|---|---|---|---|
| F1 | 260 | — | — | .19 | 100 |
| F1 | 219 | S8 | 6.7 | .19 | 120 |
| F1 | 197 | S8 | 16 | .19 | 123 |
| F1 | 197 | S8 | 32 | .20 | 113 |
| F1 | 125 | S8 | 113 | .19 | 111 |

Examples 3, 4, 5, 6 and 7 demonstrate that the combination of the dyes of this invention provide improved sensitometric benefit over the individual use of the dyes. The advantage provided is that less dye is required to reach optimum sensitometric response.

What is claimed is:

1. A photographic element comprising a support with at least one hydrophilic colloid layer coated thereon; said hydrophilic colloid layer comprises silver bromide grains with up to 5% iodide, by weight, which are spectrally sensitized with at least one first dye represented by

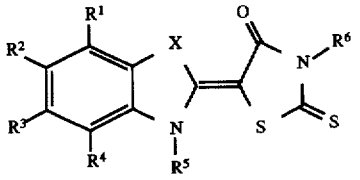

wherein:

$R^1$, $R^2$, $R^3$, and $R^4$ independently represents H, halogen, alkyl, aryl, alkoxy, carbonyl or sulfonate, or $R^1$ and $R^2$ or $R^2$ and $R^3$ or $R^3$ and $R^4$ are taken together to represent the atoms necessary to complete a six-membered carbocylic ring;

$X^1$ represents O, S, CH=CH, Se, Te, N—$R^7$, or C—$R^8R^9$;

$R^5$ represents alkyl or aryl;

$R^6$ represents H, alkyl or aryl; and $R^7$, $R^8$ and $R^9$ each independently represents alkyl;

and at least one second dye represented by

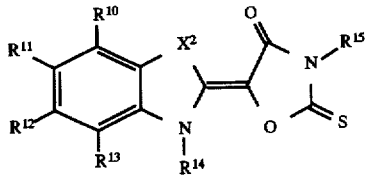

wherein:

$R^{10}$, $R^{11}$, $R^{12}$, and $R^{13}$ each independently represents H, halogen, alkyl, aryl, alkoxy, carbonyl or sulfonate or $R^{10}$ and $R^{11}$ or $R^{11}$ and $R^{12}$ or $R^{12}$ and $R^{13}$ are taken together to represent the atoms necessary to complete a six-membered carbocylic ring;

$X^2$ represents O, S, CH=CH, Se, Te, N—$R^{16}$, C—$R^{17}R^{18}$;

$R^{14}$ represents alkyl or aryl;

$R^{15}$ represents H, alkyl or aryl;

$R^{16}$ represents alkyl; and $R^{17}$ and $R^{18}$ each independently represents alkyl.

2. The photographic element of claim 1 where $X^1$ is S or Se.

3. The photographic element of claim 2 where $X^1$ is S.

4. The photographic element of claim 1 where $X^2$ is S, Se, or $NR^{18}$.

5. The photographic element of claim 3 where $X^2$ is S or Se.

6. The photographic element of claim 5 where $X^2$ is S.

7. The photographic element of claim 1 where said first dye is:

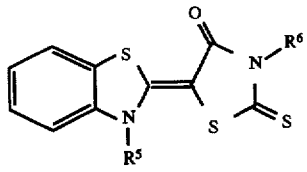

and said second dye is chosen from the set consisting of:

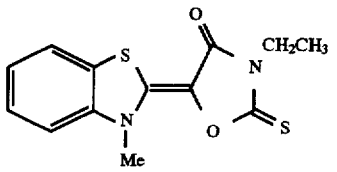

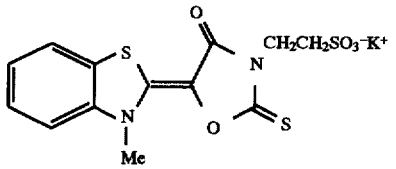

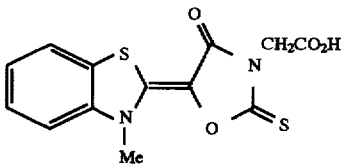

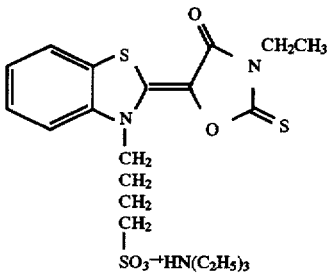

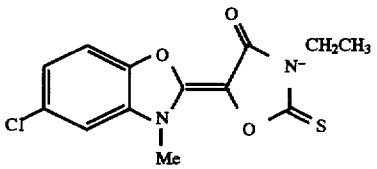

and

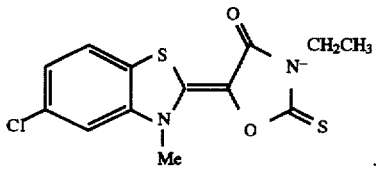

8. The photographic element of claim 7 where:

$R^5$ is $CH_3$; and $R^6$ is $CH_2CO_2H$.

9. A photographic element comprising a support with at least one hydrophilic colloid layer coated thereon;

said hydrophilic colloid layer comprises silver halide grains which are spectrally sensitized with at least one first dye represented by:

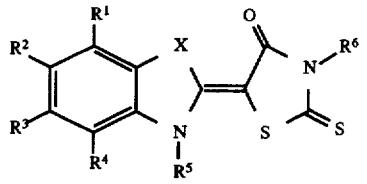

wherein $R^1$, $R^2$, $R^3$, and $R^4$ each independently represents H, halogen, alkyl, aryl, alkoxy, carbonyl, or sulfonate, or $R^1$ and $R^2$ or $R^2$ and $R^3$ or $R^3$ and $R^4$ are taken together to represent the atoms necessary to complete a six-membered carbocylic ring;

X represents O, S, CH=CH, Se, Te, N—$R^7$, or C—$R^8R^9$;

$R^5$ represents alkyl or aryl;

$R^6$ represents H, alkyl or aryl;

$R^7$ represents alkyl; and $R^8$ and $R^9$ each independently represents alkyl;

and at least one second dye represented by

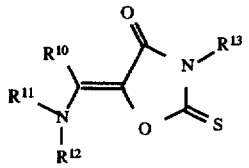

wherein $R^{10}$, $R^{11}$, and $R^{12}$ each independently represents H, alkyl, or aryl, or $R^{11}$ and $R^{12}$ are taken together to represent the atoms necessary to complete a five-membered or six-membered heterocyclic ring; and $R^{13}$ represents H, alkyl or aryl.

10. The photographic element of claim 9 wherein said hydrophilic colloid layer comprises silver bromide grains with up to 2% iodide, by weight.

11. The photographic element of claim 9 wherein said hydrophilic colloid layer comprises tabular silver bromide grains with an aspect ratio of at least 2:1.

12. The element of claim 9 where said first dye is:

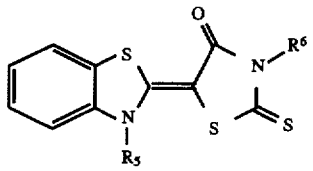

and said second dye is chosen from the set consisting of:

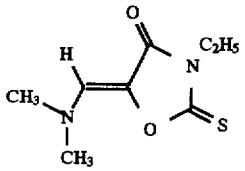

and

-continued

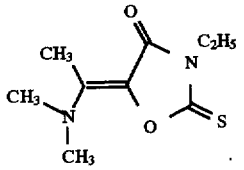

13. A photographic element comprising a support with at least one hydrophilic colloid layer coated thereon;

said hydrophilic colloid layer comprises silver halide grains which are spectrally sensitized with at least one first dye represented by

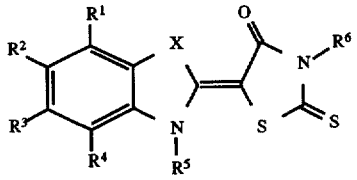

wherein $R^1$, $R^2$, $R^3$, and $R^4$ each independently represents H, halogen, alkyl, aryl, alkoxy, carbonyl, or sulfonate, or $R^1$ and $R^2$ or $R^2$ and $R^3$ or $R^3$ and $R^4$ are taken together to represent the atoms necessary to complete a six-membered carbocylic ring;

X represents O, S, CH=CH, Se, Te, N—$R^7$, C—$R^8R^9$;

$R^5$ represents alkyl or aryl;

$R^6$ represents H, alkyl or aryl;

$R^7$ represents alkyl; and $R^8$ and $R^9$ each independently represents alkyl;

and at least one second dye represented by

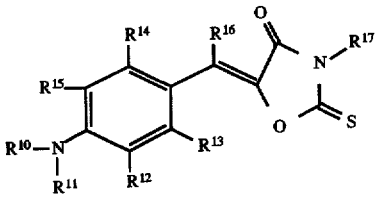

wherein $R^{10}$, $R^{11}$, $R^{12}$, $R^{13}$, $R^{14}$, and $R^{15}$ each independently represents H, alkyl, and aryl; or $R^{10}$ and $R^{11}$ or $R^{11}$ and $R^{12}$ or $R^{10}$ and $R^{15}$ are taken together to represent the atoms necessary to complete a five- or six-membered heterocyclic ring or $R^{12}$ and $R^{13}$ or $R^{14}$ and $R^{15}$ are taken together to represent the atoms necessary to complete a five- or six-membered carbocylic ring;

$R^{16}$ represents H, alkyl or aryl; and $R^{17}$ represents H, alkyl or aryl.

14. The photographic element of claim 13 where said first dye is:

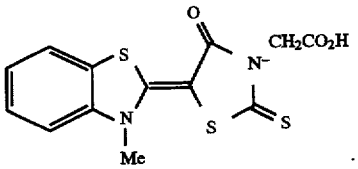

15. The photographic element of claim 13 where said second dye is:

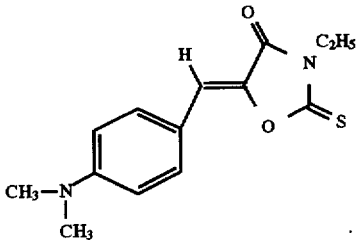

16. The photographic element of claim 15 where said first dye is:

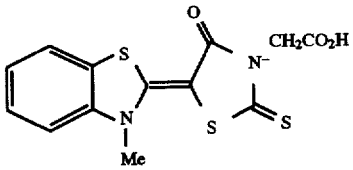

and said second dye is:

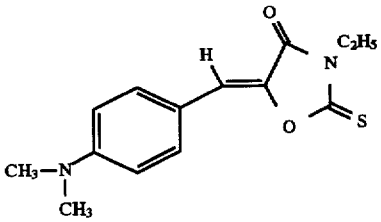

17. The photographic element of claim 1 wherein said hydrophilic colloid layer comprises silver bromide grains with up to 2% iodide, by weight.

18. The photographic element of claim 1 wherein said hydrophilic colloid layer comprises tabular silver bromide grains with an aspect ratio of at least 2:1.

* * * * *